US005097114A

United States Patent [19]

Mann et al.

[11] Patent Number: 5,097,114

[45] Date of Patent: Mar. 17, 1992

[54] LOW-VOLTAGE HEATING DEVICE

[75] Inventors: Stephen C. Mann, Wales; David L. Doubet, Watertown; Gary D. Etter, Wauwatosa, all of Wis.

[73] Assignee: General Signal Corporation, Stamford, Conn.

[21] Appl. No.: 571,163

[22] Filed: Aug. 23, 1990

Related U.S. Application Data

[63] Continuation-in-part of Ser. No. 510,257, Apr. 17, 1990.

[51] Int. Cl.[5] ..... H05B 3/10

[52] U.S. Cl. ..... 219/553; 219/552; 219/528; 219/496; 373/110; 373/127; 266/128; 432/209

[58] Field of Search ..... 373/3, 5, 27, 127, 128, 373/109, 110, 114, 116–119; 219/200, 389, 553, 552, 528, 496; 266/128, 173, 252, 905; 422/209; 432/209, 114

[56] References Cited

U.S. PATENT DOCUMENTS

| | | | |
|---|---|---|---|
| 1,432,064 | 10/1922 | Hadaway | 219/552 |
| 2,896,004 | 7/1959 | Duffy et al. | 373/130 |
| 4,135,053 | 1/1979 | Kastilahn et al. | 373/110 |
| 4,215,233 | 7/1980 | Kastilahn | 373/127 |
| 4,332,552 | 6/1982 | Seelandt | 432/209 |
| 4,701,933 | 10/1987 | Evensen | 373/117 |

FOREIGN PATENT DOCUMENTS

| | | | |
|---|---|---|---|
| 2031694 | 11/1970 | France | 373/127 |

*Primary Examiner*—Bruce A. Reynolds
*Assistant Examiner*—Tu Hoang
*Attorney, Agent, or Firm*—Robert R. Hubbard; John F. Ohlandt

[57] ABSTRACT

A low-voltage electric heating device for application in a carburizing furnace is provided with an outer housing or sleeve for replaceable disposition within the furance, the outer housing radiating heat directly into said furnace; at least one current path conductor is positioned within the outer housing, the current path conductor being electrically connectable to a source of power and electrically insulated from a substantialy part of the outer housing. The heat radiated from the heating device is concentrated in the lower part because a current path has in series at least the current path conductor and at least a corresponding part of the outer housing, the resistance of the lower part of the outer housing being relatively large with respect to the remainder of the current path.

17 Claims, 5 Drawing Sheets

LOW-VOLTAGE HEATING DEVICE

This is a continuation-in-part of application Ser. No. 510,257, filed Apr. 17, 1990. The benefit of the filing date of the parent application as to all common subject matter is herewith claimed.

The present invention provides a novel electrified single-ended tube heating device which can be replaceably disposed within a carburizing integral quench furnace. Furthermore, the present invention relates to electric heating furnaces, and more particularly to electrical resistance heating type heat treating or melting furnaces in which the heating device is incorporated.

BACKGROUND OF THE INVENTION

Conventional carbonaceous furnaces for the processing of steel, etc. have included both electric and gas heating elements. Early furnace designs included a plurality of relatively small heating elements in spaced relation in a furnace heated by the flow of electric current therethrough. Such elements require a relatively high voltage, which results in electric insulation problems and current leakage through the refractory lining of the furnace due to carbon deposits. High voltage is also responsible for or injury to personnel who accidentally touch the elements.

Another difficulty encountered is control of the desired radiant heat distribution in the furnace and particularly in a heat treating furnace.

In an effort to overcome the above disadvantages, relatively large flat heating elements were extended over a large area of the furnace wall to produce a uniform heating effect. The heating elements were formed by corrugated sheets or strips mounted adjacent to the furnace walls. These corrugated heating elements are set forth in U.S. Pat. No. 2,896,004 (Duffy et al.), issued July 21, 1959.

The corrugated heating elements, as noted above, resulted in a maintenance problem, wherein replacement required entering the furnace and removing the elements from the furnace walls. In order to overcome this maintenance problem, U-tube heating elements were developed. A typical U-tube heating element is disclosed in U.S. Pat. No. 4,332,552 (Seelandt), which issued on June 1, 1982. The U-tube heating elements solved the maintenance problems associated with the corrugated heating elements by permitting removal of the elements through the roof of the furnace.

The U-tube heating element operates on extremely low voltage, which permitted disposition of the element directly in a carbonaceous atmosphere. Since there is no need to isolate the element from the atmosphere, the element is free to radiate directly within the heat chamber, thereby lowering element operating temperatures over those designs where the elements are placed inside of the radiant tube. The U-tube elements are plug-mounted in the roof for ease of service. Four elements are usually utilized, two per sidewall, for maximum radiating area and extend above, below and beyond the workpiece.

Unfortunately, U-tube heating elements require very large openings in the furnace roof and are not interchangeable with gas fired, "single-ended" radiant tubes; that is to say, straight tubes requiring only that a single small roof opening be provided, contrasted with U-shaped elements. Therefore, the present inventor undertook the development of a unique electrified single-ended tube heating device which is easily replaceable and can be interchanged with the aforesaid gas fired, single-ended radiant tubes.

The present invention overcomes the high voltage and maintenance problems of conventional furnace heating elements. That is, the electrified single-ended tube heating device of the present invention is a low voltage heating device which permits operating directly in a carbonaceous atmosphere. Its unique design also facilitates field replacement or conversion to gas fired single-ended radiant tubes while minimizing the size of the roof openings.

The present invention also provides many additional advantages which shall become apparent as described below.

SUMMARY OF THE INVENTION

A low voltage electric heating device for application in a furnace which comprises: a cylindrical outer housing or sleeve replaceably disposed within a carburizing integral quench furnace and, in one preferred embodiment, electrically connected to a first electric terminal; and at least one low resistance current path conductor disposed within the outer housing, this current path conductor being electrically connected to a second electric terminal and electrically insulated from the outer housing except at its connection point near the bottom of the outer housing.

In another embodiment, the electric heating device may include a first current path element and a second current path element disposed within the outer housing or sleeve. The first current path element preferably traverses, or is coextensive with, the entire length of the outer housing and the second current path element traverses only a portion of the outer housing, the second element being electrically connected to the outer housing at a point where it is desired to decrease the radiant heat input of the outer housing.

In either embodiment, the outer housing or sleeve radiates heat directly, and selectively, into the carbonaceous atmosphere during the processing of the workpiece. By "selectively" is meant that the radiated heat is concentrated where it is most needed; namely in the lower part of the furnace chamber.

Other and further objects, advantages and features of the present invention will be understood by reference to the following specification in conjunction with the annexed drawings, wherein like parts have been given like numbers.

DESCRIPTION OF PREFERRED EMBODIMENTS

Figure 1:
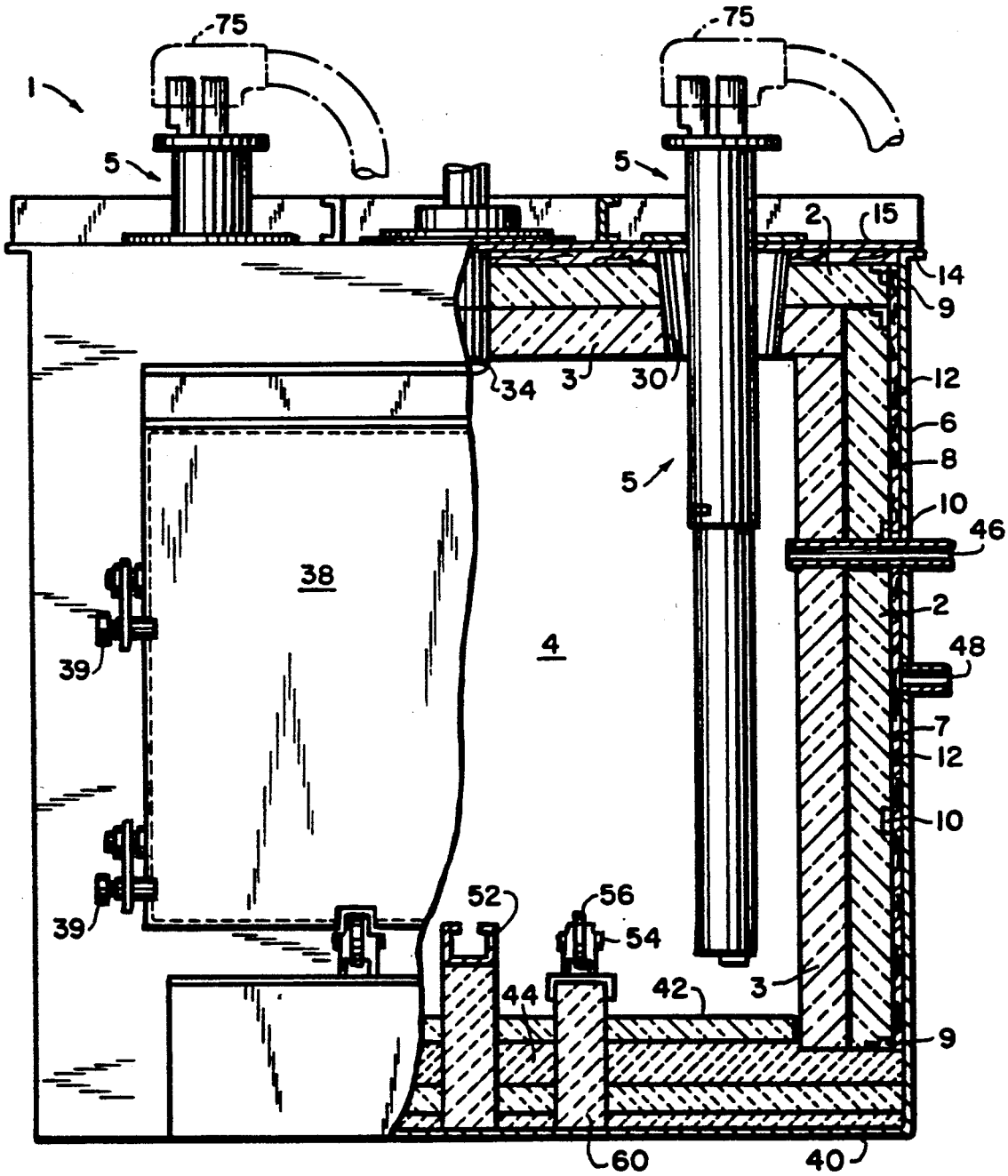
FIG. 1 is a schematic cross-sectional view of a carburizing integral quench furnace heating chamber fitted with an electric heating device in accordance with the present invention.
Figure 2:
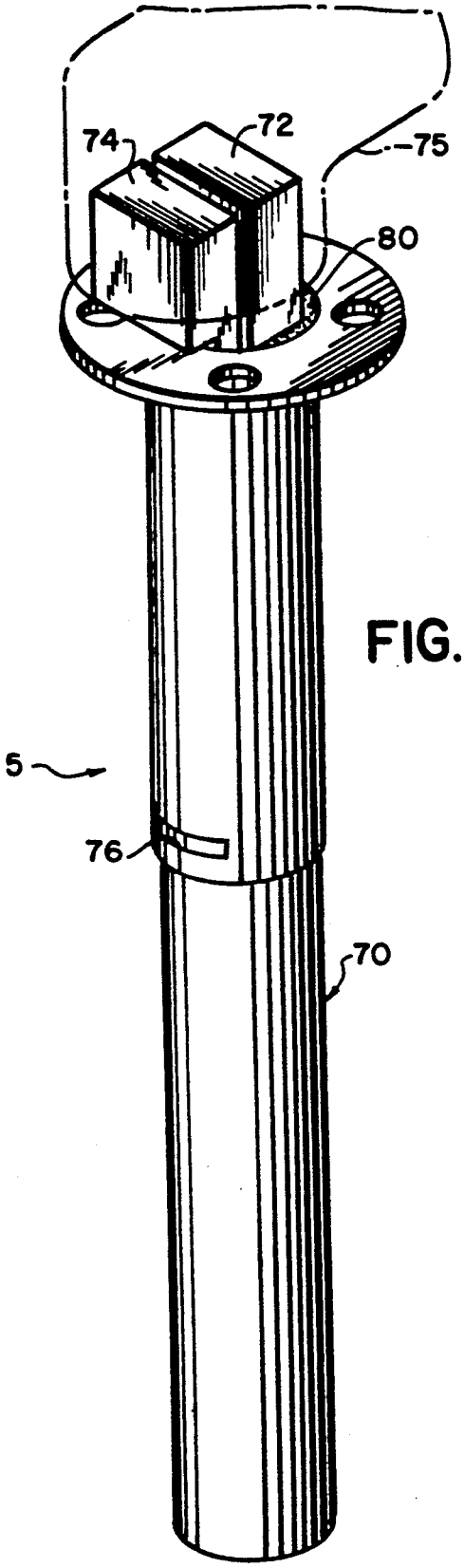
FIG. 2 is a top front perspective view of an electric heating device in accordance with the present invention provided with two center current path conductors.

The present invention can best be described while referring to the attached drawing, wherein FIG. 1 depicts a carburizing integral quench furnace assembly 1 which includes an exterior panel 2 and an interior panel 3. Panels 2 and 3 are typically formed of a fibrous material. The panels serve to enclose the furnace chamber 4 into which is inserted at least one single-ended electric heating device 5. The panels (2,3) are fitted within a steel or other type of furnace shell 6 so as to form a space 7 therebetween on the order of one inch, although the exact dimensioning will depend on the type of furnace and its corresponding dimensions. Space 7 may either be left unfilled or may have inserted therein a blanket of fibrous material (not shown) which is receptive to the passage of gas therethrough.

The side and rear wall assemblies 8 include a rectangularly shaped outer frame 9, a center bar (not shown) and a plurality of cross bars 10 which interconnect the center bar with frame 9. Wall assembly 8 is constructed by securing blocks of fibrous material to the center bar and cross bars 10 by use of clips, retainers, bolts or other conventional securing members so as to support at least an exterior panel 2 and, under some circumstances, an interior panel 3, with a blanket of insulating material (not shown) being inserted between adjacent panels. Moreover, spacers 12 in the form of bolts and threaded rods can be used to either secure panel 2 to furnace shell 6 or to assure that proper spacing to form space 7 is provided. Furnace shell 6 also includes an outwardly extending flange 14 for cooperation with roof assembly 15 which also includes a frame 9 similar to the wall assemblies for securing exterior panel 2 and interior panel 3 thereto. Roof assembly 15 includes a plurality of tapered openings 30 within which heating device 5 is mounted.

Reference number 34 denotes an opening in roof assembly 15 for mounting of a gas circulation fan (not shown). Door assembly 38 includes a plurality of pins 39 attached thereto for cooperating with the furnace assembly. Floor assembly 40 includes a floor panel 42 of fibrous material mounted on a plurality of layers of brick insulation 44. Floor assembly 40 also includes a furnace snake chain guide assembly 52 used to transfer steel or other workpieces into furnace chamber 4. Roller rails 54 are also provided so as to assist in transferring the workpiece into furnace chamber 4 with cast rollers 56 being mounted on roller rails 54. Floor assembly 40 is provided with a rail support 60 upon which roller rails 54 are mounted.

Reference number 46 designates a first source of purging gas (i.e., nitrogen is commonly used but other types of inert gases are acceptable) which may be supplied to furnace chamber 4. Reference number 48 denotes a second source of purging gas which can be supplied to space 7 formed between panel 2 and furnace shell 6.

The furnace assembly 1 thus serves to provide a furnace chamber 4 which, during operation, is heated by heating device 5 to a temperature between 500° and 2000° F. such that purging gas is introduced from the first source 46 which may include any inert gas. The purging gas can be an enriched endothermic atmosphere within the furnace chamber and is circulated about the furnace by operation of a gas circulating fan (not shown). The protective atmosphere within furnace chamber 4 is also subjected to a pressure which is approximately 0.2 ounces/inch$^2$ above atmospheric pressure. A corresponding auxiliary gas purge can also be accomplished by the introduction of nitrogen or a similar type gas under pressure approximately 0.2 ounces/inch$^2$ or more above atmospheric pressure within space 7 via secondary gas source 48. Due to the fibrous composition of the panels (2,3), the nitrogen gas under pressure serves to assist purging of the furnace itself by keeping the exterior surface of exterior panel 2 at a lower temperature than is possible in a conventional furnace and purges water vapor and air by forcing the same towards the furnace chamber 4.

The unique heating device of the present invention is depicted in a first embodiment as having a pair of current path conductors, as seen in FIGS. 2–8. Therein, a low voltage electric heating device 5 comprises a cylindrical outer housing or sleeve 70 replaceably disposed within furnace assembly 1 and electrically connected to an electric supply system by way of a first electric connector 71. A first low resistance current path conductor 72 and a second current path conductor 74 are disposed within outer housing or sleeve 70. The current path conductors (72,74) are independently electrically connected to the electrical system by way of the first electric connector 71, being electrically insulated from each other along their lengths.

Figure 4:
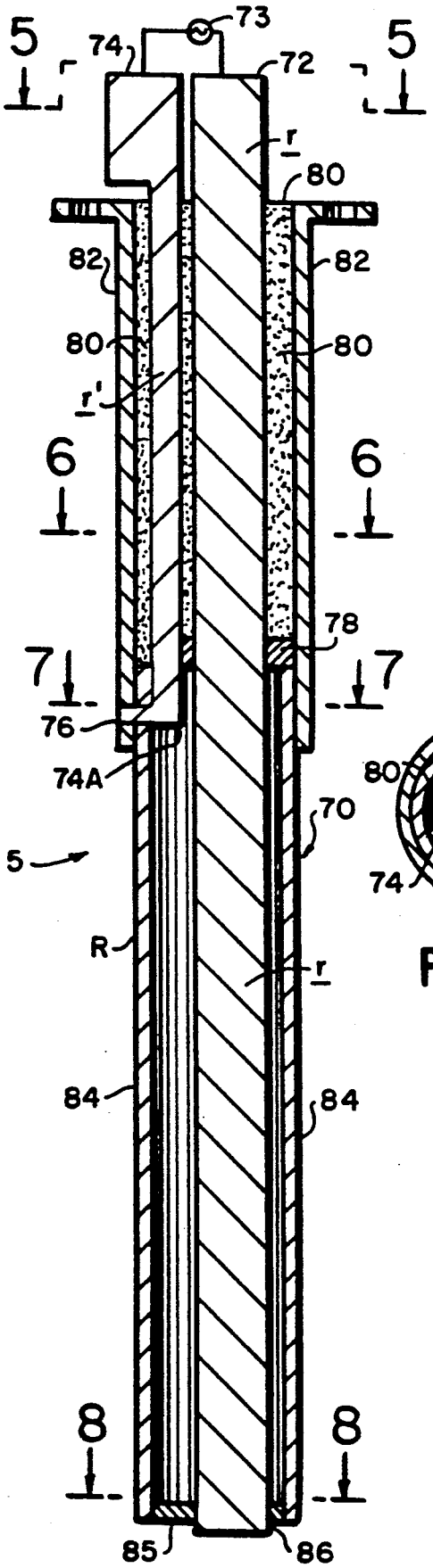
FIG. 4 is a cross-sectional view of an electric heating device in accordance with the present invention, having two current path elements.

First current path conductor 72 preferably traverses, or is coextensive with, the entire length of outer housing 70, FIG. 4, whereas second current path conductor 74 traverses only a portion thereof. Cylindrical outer housing 70 is provided at its lower end with a disk-like portion 85 having an opening 86 such that first current path conductor 72 may, while making electrical contact with disk 85, conveniently extend beyond the confines of outer housing 70. Cylindrical outer housing 70 may also include a slot 76 about its sidewall such that a lower end of second current path conductor 74 is exposed to the carbonaceous atmosphere which surrounds outer housing 70. The conductor 74 is welded to housing 70 at this location.

Figure 3:
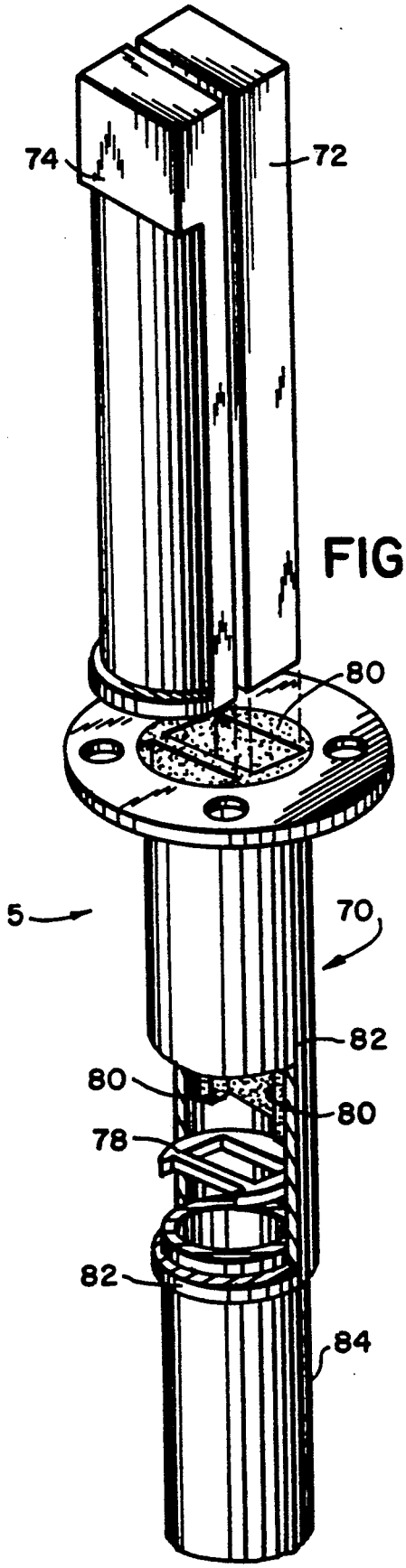
FIG. 3 is an exploded top front perspective view of the electric heating device of FIG. 2.

As depicted in FIG. 3, first current path conductor 72 is preferably rectangular in cross-section throughout, whereas second current path conductor 74 is substantially semicircular in cross-section for most of its length. As will be appreciated, the reason for this configuration is so that conductor 74 will fit within the circumference of tube or sleeve 70.

Outer sleeve 70 may also include a guide bracket 78 capable of preventing shorting and also capable of insulating first current path conductor 72 from second current path conductor 74. Guide bracket 78 is formed from a ceramic material.

FIG. 4 is a cross-sectional view of heating device 5. The low resistance current path conductors (72,74) are insulated from each other and outer housing 70 by insulation 80. Insulation 80 is typically a loose ceramic fiber. When multiple current path bars or elements are used, they typically have a gap therebetween of approximately ¼".

Cylindrical outer sleeve or tube 70 preferably comprises a first tubular member 82 having a flanged end, and a second tubular member 84 connected to first tubular member 82 by welding. These tubular members are provided with a slot 76 which permits a lower shoulder portion 74A of second current path conductor 74 to be in electrical contact with tube 70 so that a complete series circuit path is established from 74, then by way of the lower part of tube 70, and return through metallic disk 85 and conductor 72. Second tubular member 84 includes an opening 86 at one end thereof such that metallic disk 85 may be fitted therein and make electrical contact with conductor 72 and tubular member 84.

Heating device 5 functions by having the electric current from the AC source 73 passed through the described circuit, including tube 70, so that the heat required by the furnace is principally radiated from the lower part of tube 70, which has a relatively large resistance R, compared with the smaller resistances r and r' respectively of conductors 72 and 74.

Figure 5:
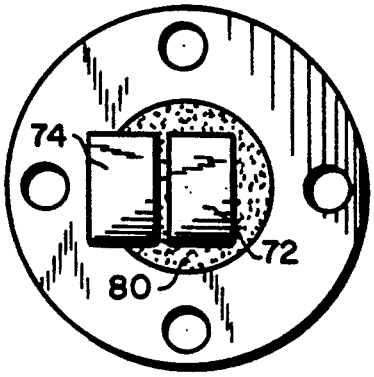
FIG. 5 is a top plan view along line 5—5 of FIG. 4.

FIG. 5 is a top plan view along line 5—5 of FIG. 4, in which first current path conductor 72 is disposed in the center of outer housing 70 and second current path conductor 74 is disposed nearer to one side of tube 70.

Figure 6:
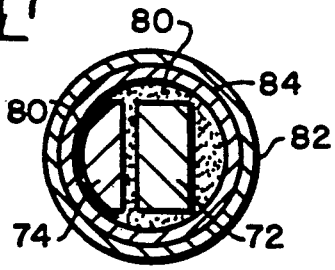
FIG. 6 is a cross-sectional view along line 6—6 of FIG. 4.

FIG. 6 is a cross-sectional view along line 6—6 of FIG. 4 and depicts the semicircular and rectangular shapes of conductors 74 and 72, respectively.

Figure 7:
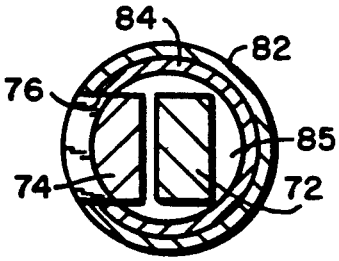
FIG. 7 is a cross-sectional view along line 7—7 of FIG. 4.

FIG. 7 is a cross-sectional view along line 7—7 of FIG. 4 and depicts the positioning of conductor 74 within slot 76.

Figure 8:
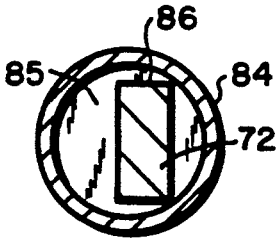
FIG. 8 is a cross-sectional view along line 8—8 of FIG. 4.

FIG. 8 is a cross-sectional view along line 8—8 of FIG. 4, wherein conductor 72 is contained within tubular member 84 and metallic disk 85 connects conductor 72 and tubular member 84.

Figure 9:
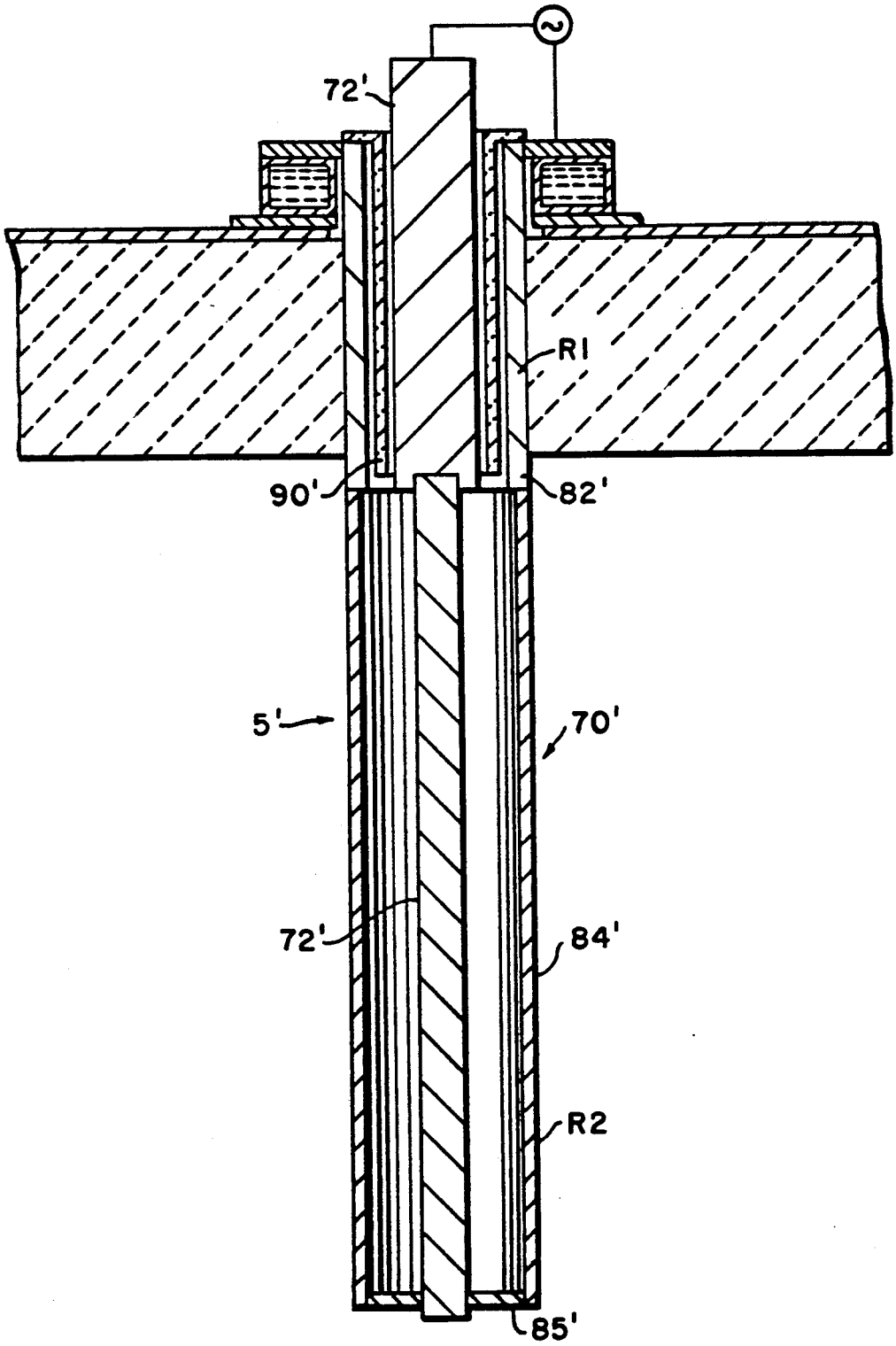
FIG. 9 is a cross-sectional view of an alternate embodiment of the electric heating device of the invention.

Referring now to FIG. 9, there will be seen an alternate preferred embodiment of the heating device in accordance with the present invention. Similar numerals in the form of prime numerals have been applied to this figure.

Instead of two low resistance current path conductors as was the case with the previous preferred embodiment, only one very low resistance conductor 72' is utilized, such element being located on the axis of the device 5'. In this embodiment, the outer housing or sleeve 70' comprises two tubular members 82' and 84' suitably connected at adjacent ends, as was the case before. However, herein a much lower resistance R1 is chosen for the upper tubular member 82'; and a much higher resistance R2 for the lower tubular member 84'. Consequently, when a source of power is connected to the upper end of conductor 72' and to the upper end of sleeve 70', current flows through the series circuit comprising such conductor 72' and sleeve 70', the lower end of 70' providing a metallic connection 85' to the conductor 72'. Accordingly, the lower tubular member 84' with its much higher resistance will produce the significantly radiated heat from the heating device. A cylindrical ceramic insulator 90' is located at the upper part of device 5', disposed between conductor 72' and tubular member 82'. The length of the upper tubular member 82' can be adjusted to control the heating length of sleeve 70'.

Figure 10:
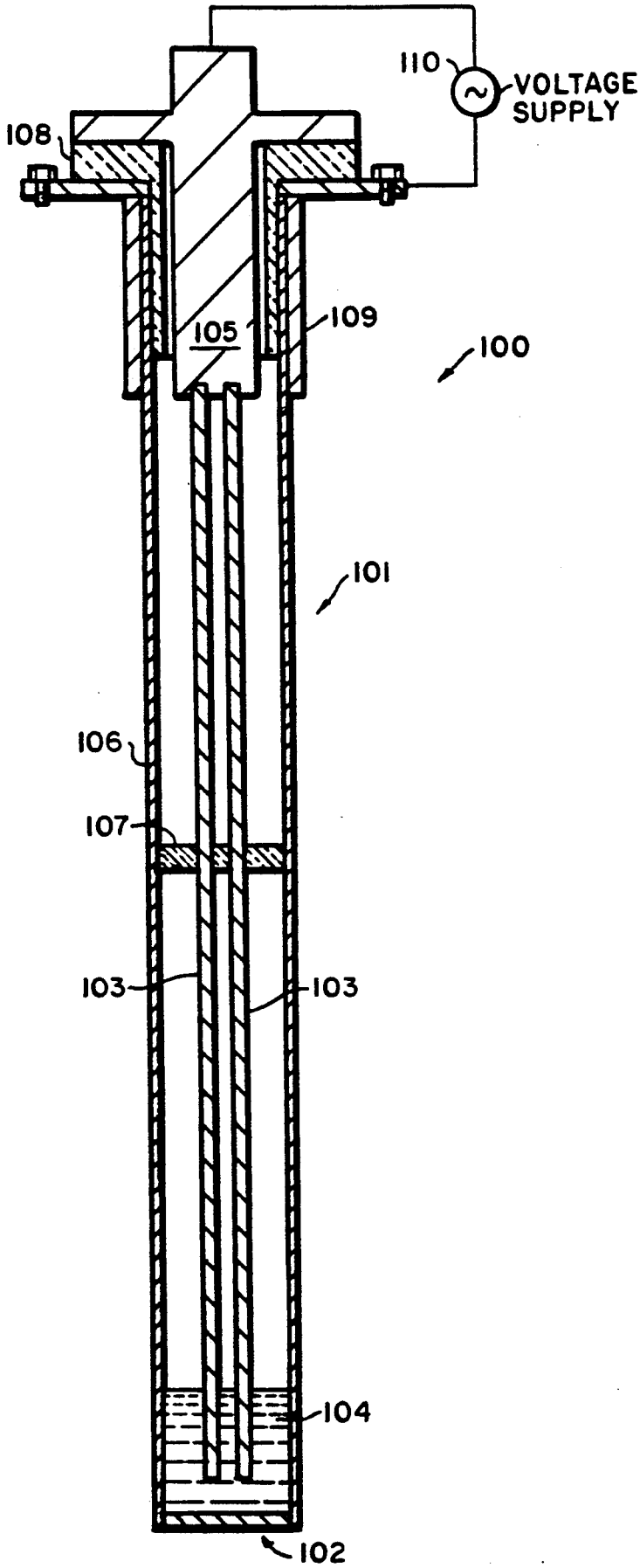
FIG. 10 is a cross-sectional view of another alternate embodiment of the electric heating device of the invention.

FIG. 10 depicts another alternate preferred embodiment of the heating device in accordance with the present invention, involving a fluid terminal connection. The primary purpose of this embodiment is to overcome the effects of linear expansion of hollow heating devices which occasionally lead to premature failure of the electrical connection at the bottom of the device.

Heating device 100 comprises an outer housing 101 made of a material such as Kanthal and which is closed at one end by means of end cap 102. At least one conductor rod 103 is suspended in the center of outer housing 101. The lower end of outer housing 101 is filled with metal 104 which becomes molten at the elevated operating temperatures, such as tin, lead, or an alloy of two or more of the above metals, or any other suitable metal. Sufficient molten metal 104 is disposed in the bottom of outer housing 101 to electrically connect conductor rod 103 to outer housing 101. Current passes through conductor rod 103, molten metal 104, and outer housing 101 such that outer housing 101 increases in temperature and functions as a heating element.

Instead of two low resistance current path conductors as was the case with some of the previous preferred embodiments, only one very low resistance current path conductor 105 is utilized, such conductor 105 being located on the axis of the device 100. In this embodiment, outer housing or sleeve 101 comprises a singular tubular member 106. Consequently, when a source of power is connected to the upper end of conductor 105 and to the upper end of sleeve 101, current flows through the series circuit comprising such conductor 105 (including conductor rod(s) 103), molten metal 104 and sleeve 101, molten metal 104 providing an electrical connection between conductor rod(s) 103 and sleeve 101. Conductor rod(s) 103 are supported within sleeve 101 by insulating means 107. A cylindrical ceramic insulator 108 is located at the upper part of device 100, disposed between conductor 105 and sleeve 101. A support tube 109 is attached about sleeve 101 and electrically connected to voltage supply 110.

Optionally, a heat sink, not shown, may be used to reduce stress at the bottom of the outer housing caused by heat expansion between the conductor rod(s) and the outer housing or sleeve. Furthermore, the conductor rods preferably have a cylindrical shape and have holes disposed within the ends thereof to increase their surface area.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

We claim:

1. A low voltage electric heating device for application in a furnace, said device having an upper part and a lower part, which comprises:

an outer housing for replaceable disposition within said furnace, said outer housing radiating heat directly into said furnace;

at least one current path conductor positioned within said outer housing, said current path conductor being electrically connectable to a source of power and electrically insulated from a substantial part of said outer housing;

means for concentrating the heat radiated from said device at said lower part of said device, said means including a current path having in series at least said one current path conductor and at least a corresponding part of said outer housing, the resistance of said corresponding part of said outer housing being relatively large with respect to the resistance of the remainder of said current path.

2. The heating device according to claim 1, in which said current path conductor is coextensive with the predetermined length of said outer housing; further in which said outer housing has an upper and a lower part, the resistance of the lower part of said outer housing being relatively large with respect to the resistance of the upper part.

3. The heating device according to claim 1, in which said outer housing is open at one end such that said current path conductor extends beyond said outer housing to enable connection of said current path conductor to a source of power.

4. The heating device according to claim 1, in which said current path conductor has a rectangular cross-section.

5. The heating device according to claim 1, in which said outer housing includes a guide bracket capable of guiding said current path conductor and insulating said current path conductor from said outer housing.

6. The heating device according to claim 5, in which said guide bracket is formed from a ceramic material.

7. The heating device according to claim 1, further including a second current path conductor, said second conductor being in electrical contact with said outer housing to define a series circuit with a part of said outer housing.

8. The heating device according to claim 1, in which said current path conductor is insulated from said outer housing by insulation in the form of a loose fiber.

9. The heating device according to claim 1, in which said outer housing comprises a first tubular member having a flanged end and a second tubular member connected to said first tubular member, said second tubular member having a higher resistance than said first tubular member.

10. A low voltage electric heating device for application in a furnace, said device having an upper part and a lower part, which comprises:

a cylindrical outer housing for replaceable disposition within said furnace, said outer housing radiating heat directly into said furnace; and a first current path conductor and a second current path conductor disposed within said outer housing, said current path conductors being electrically connectable to respective first and second terminals of a source of power;

said conductors being electrically insulated from each other and, in part, from said outer housing;

means for concentrating the heat radiated from said device at said lower part of said device, said means including a current path having in series said first and second current path conductors, and at least a corresponding part of said outer housing, the resistance of said corresponding part of said outer housing being relatively large with respect to the resistance of the remainder of said current path.

11. The heating device according to claim 10, in which said first current path conductor extends axially for the entire length of said outer housing, and said second current path conductor extends axially for only a portion of the length of said outer housing, making electrical contact with said outer housing to define a series circuit for generating heat.

12. The heating device according to claim 10, in which said cylindrical outer housing is open at one end such that said first current path conductor extends beyond said outer housing to enable connection with said source of power.

13. The heating device according to claim 1, wherein said outer housing has a bottom and wherein said current path conductor includes at least one conductor rod positioned within said outer housing and having a length less than that of said outer housing, and a molten metal disposed at the bottom of said outer housing and in contact with said outer housing and said conductor rod.

14. The heating device according to claim 13, wherein said molten metal is at least one metal selected from the group consisting of: lead and tin.

15. The heating device according to claim 13, where the bottom of said outer housing is formed by an end cap.

16. The heating device according to claim 13, wherein said conductor rod is cylindrical in shape.

17. The heating device according to claim 13, wherein said conductor rod has holes disposed therein, said holes disposed near the bottom of said outer housing.

* * * * *